US010071006B2

(12) United States Patent
Egelund et al.

(10) Patent No.: US 10,071,006 B2
(45) Date of Patent: Sep. 11, 2018

(54) INFLATABLE AIR CUSHION WITH PRESSURE INDICATOR

(71) Applicant: Idéen ApS, Solbjerg (DK)

(72) Inventors: Peter Egelund, Solbjerg (DK); Poul Solbjerg, Solbjerg (DK)

(73) Assignee: Ideen ApS, Solbjerg (DK)

( * ) Notice: Subject to any disclaimer, the term of this patent is extended or adjusted under 35 U.S.C. 154(b) by 0 days.

(21) Appl. No.: 15/509,215

(22) PCT Filed: Sep. 8, 2015

(86) PCT No.: PCT/DK2015/050269
§ 371 (c)(1),
(2) Date: Mar. 7, 2017

(87) PCT Pub. No.: WO2016/037625
PCT Pub. Date: Mar. 17, 2016

(65) Prior Publication Data

US 2017/0252246 A1 Sep. 7, 2017

(30) Foreign Application Priority Data

Sep. 8, 2014 (DK) ..... 2014 00509
Mar. 23, 2015 (DK) ..... 2015 70161
Apr. 29, 2015 (DK) ..... 2015 70248

(51) Int. Cl.
*A61G 7/057* (2006.01)
*A47C 27/08* (2006.01)
*A47G 9/10* (2006.01)

(52) U.S. Cl.
CPC ..... *A61G 7/05769* (2013.01); *A47C 27/082* (2013.01); *A47C 27/083* (2013.01); *A47G 9/1027* (2013.01)

(58) Field of Classification Search
CPC ..... A47C 27/082; A47C 27/083
(Continued)

(56) References Cited

U.S. PATENT DOCUMENTS 2,253,801 A * 8/1941 Neal ..... A47C 27/081 267/117
3,546,944 A * 12/1970 Mack ..... A61F 5/05816 116/266
(Continued)

FOREIGN PATENT DOCUMENTS

JP 2004016521 A 1/2004
KR 20100012528 A 2/2010
WO 2009102968 A1 8/2009

*Primary Examiner* — Fredrick C Conley
(74) *Attorney, Agent, or Firm* — James Creighton Wray; Meera P. Narasimhan

(57) ABSTRACT

The present invention concerns an inflatable air cushion with at least one pressure indicator, the cushion including an outer side and at least one chamber, the at least one chamber made up of one or more films that are joined, thereby forming one or more airtight chambers, the cushion furthermore including a valve opening for connecting an air supply line, the valve opening being accessible from the surface of the cushion. The invention furthermore relates to a method of inflating such an inflatable cushion with pressure indicator. The new feature of a cushion according to the invention is that the pressure indicator of the cushion includes at least one strap with a first end and a second end, the at least one strap arranged in relation to the surface of the cushion, where the at least one strap is surrounding the cushion entirely or partially, and where the at least one strap is adapted such that the physical appearance of the strap is changed at a given pressure in the cushion, thus constituting a pressure indicator.

9 Claims, 4 Drawing Sheets

(58) Field of Classification Search
USPC ..... 5/706, 710, 713, 655.3
See application file for complete search history.

(56) References Cited

U.S. PATENT DOCUMENTS

| | | | | |
|---|---|---|---|---|
| 5,771,514 | A | 6/1998 | Wilhoit | |
| 6,000,079 | A * | 12/1999 | Dranger ..... | A47C 4/54<br>425/522 |
| 2003/0217601 | A1 | 11/2003 | Seals | |
| 2004/0083550 | A1 | 5/2004 | Graebe | |
| 2006/0064820 | A1 | 3/2006 | Call | |
| 2014/0130261 | A1 | 5/2014 | Gumbrecht | |

* cited by examiner

INFLATABLE AIR CUSHION WITH PRESSURE INDICATOR

This application claims the benefit of Danish Application No. PA 2014 00509 filed Sep. 8, 2014, Danish Application No. PA 2015 70161 filed Mar. 23, 2015, Danish Application No. PA 2015 70248 filed 29 Apr. 2015 and PCT/DK2015/050269 filed Sep. 8, 2015, International Publication No. WO 2016/037625 A1, which are hereby incorporated by reference in their entirety as if fully set forth herein.

FIELD OF THE INVENTION

The present invention concerns an inflatable air cushion with at least one pressure indicator, the cushion including an outer side and at least one chamber, the at least one chamber made up of one or more films that are joined, thereby forming one or more airtight chambers, the cushion furthermore including a valve opening for connecting an air supply line, the valve opening being accessible from the surface of the cushion. The invention furthermore relates to a method of inflating such an inflatable cushion with pressure indicator.

BACKGROUND OF THE INVENTION

By inflating cushions, in particular for supporting persons, it is very important that the cushion contains the correct amount of air such that it provides optimal support while at the same time the cushion has an appropriately soft and yielding surface. Therefore it is important that the cushion is not inflated too hard, as in such cases it will have a negative effect in relation to supporting persons with the risk of pressure marks on the skin with subsequent pressure sores in the tissue. At the same time it is also important that there is exactly as much air in the cushion so that the skin on the hard projections of the body (heels, elbows, bones etc.) is not resting directly on the hard support under the cushion.

There are cushions for this application that are inflated manually or by an electric pump, but there is just the relatively great disadvantage that it is almost impossible to indicate a suitable degree of inflation. Actually, it is so that each staff member build their own experience, but since it is not always the same person that operates the individual patients, it is very difficult to offer uniform treatment and support with the cushions in question.

The correct amount of air in the cushion by optimal support corresponds to the cushion containing air with a modest overpressure or with a pressure corresponding to atmospheric pressure. In principle, this means that more air can be in the cushion, but with normal inflation there is no measurable pressure difference between the air inside the cushion and the ambient air outside the cushion. Also, this means that normally used indicators for indicating pressure in the inflated article—here a cushion—cannot be used for this purpose. Similarly, it will not be possible to use certain time intervals for inflating the individual cushions as different pumps with different output are used for inflating the same type of cushions.

Frequently it is therefore a challenge to find the correct amount of air for the cushion such that an optimal support is provided.

US 2014/0130261 A1 discloses an example of a cushion inflated by air, and which via a manual pump or an electric pump can be inflated with a given pressure. In a variant of this air cushion it may include an integrated electronic pressure sensor transmitting a signal about the actual pressure to either a display or a control unit. However, this is a built-in electronic device which, all things considered, comes at a cost, in this case justified by the fact that the air cushion can be used many times and thus is not a disposable article.

OBJECT OF THE INVENTION

It is the object of the invention to overcome the above mentioned drawbacks by the prior art cushions. At the same time it is the object to indicate when a correct amount of air has been pumped into a support and pressure distributing cushion, here called an air cushion or a cushion, such that it is well suited for prevention and for supporting persons in the group having a risk of pressure sores. The actual type of cushions are typically disposable articles used for a relatively short period of time and only by the same user.

DESCRIPTION OF THE INVENTION

As also mentioned by introduction, the present invention concerns an inflatable air cushion with at least one pressure indicator, the cushion including an outer side and at least one chamber, the at least one chamber made up of one or more films that are joined, thereby forming one or more airtight chambers, the cushion furthermore including a valve opening for connecting an air supply line, the valve opening being accessible from the surface of the cushion.

Such inflatable cushions are often disposable article that are used by one user only and then discarded. A cushion according to the invention can, however, be used several times right away, which will be mentioned in examples below.

A cushion is often formed of one or more pieces of plastic film joined along the periphery in order to achieve a desired and suitable shape. In its simplest form there may be two rectangular films joined along four edges, though, as indicated, there may be many shapes and constructions with many film pieces and also with several film layers. The design of the cushion itself and the material of which it is made are, however, not so important with regard to the present invention as such.

The new feature of a cushion according to the invention is that the pressure indicator of the cushion includes at least one strap with a first end and a second end, the at least one strap arranged in relation to the surface of the cushion, where the at least one strap is surrounding the cushion entirely or partially, and where the at least one strap is adapted such that the physical appearance of the strap is changed at a given pressure in the cushion, thus constituting a pressure indicator.

A cushion according to the invention will typically be folded in a suitable shape, and when inflated before being put into use it will unfold during the inflation procedure. By arranging a pressure indicator—here in the form of a strap—in relation to the surface of the cushion, the strap will be subjected to tension and thereby act as pressure indicator in that it may change appearance, e.g. by breaking, detaching from a fixation to the surface of the cushion, changing colour or shape.

When a pressure indicator is arranged in relation to the surface of the cushion, this means that the strap and the surface of the cushion itself have different lengths so that the surface of the cushion has excess length relative to the strap, or that the cushion is made of a material that is so elastic such that this material can be stretched more than the strap itself. The pressure indicator is adjusted to a predefined hardness of the cushion in question, and, when the correct amount of air has been supplied, will indicate the latter.

A cushion according to the invention may include several pressure indicators, each adapted to indicate a given pressure in the cushion. A cushion may thus be adapted to different applications with different degrees of inflation. Air can e.g. be supplied until e.g. two out of three indicators are activated.

In a variant of an inflatable cushion according to the invention, the at least one strap can be fixed at one end thereof to the surface of the cushion by a first fixation, where the at least one strap is fixed at a second end thereof to the surface of the cushion by a second fixation, where the strap between the first end and the second end includes a central part, the length of the surface of the cushion between the first and the second fixations being greater than the length of the central part of the strap.

The strap can in principle be made of two conjoined parts, where the above mentioned ends are constituted by the ends of the joined parts which in unbroken condition appear as one strap. The said central part of the strap can therefore include a joint between two or more strap parts. Such a joining can be provided by various means, including glue which is applied directly or indirectly via a jointing label that is glued across at least one strap end, whereby the said strap end is fixed to a second strap end, or at least to the strap as such.

Hereby is achieved that a pressure indicator with a modest length/size can be fixed directly or indirectly to the surface of the cushion, and that indication of the intended pressure is achieved, for example indicated by breaking of the strap, detachment from a fixation on the surface of the cushion, changing of colour or shape. An advantage hereby is that the strap does not have to surround the entire cushion or large parts of the cushion, but may be arranged in a local area which is easily observed during the inflation procedure. This is particularly relevant in case that a cushion is placed wholly or partly under a user before inflation. The cushion may in principle be a mattress or another relatively large cushion which is placed in a bed or the like before a user lies down.

A strap may, as mentioned, be fixed to the surface of the cushion, but it may as well be fixed to a film layer under the surface of the cushion, e.g. directly to the film layer forming the airtight chamber itself. Cushions of the type used for relieving and preventing pressure sores/bedsores are often made of several film layers where the inner layer has the purpose of forming one or more airtight chambers, and where the outer layers have the purpose of forming a comfortable and pleasant surface for contact with the user's skin.

In another embodiment of an inflatable cushion according to the invention, the at least one strap at one end thereof can be fixed to the other end of the strap, where the strap between the first end and the second end includes a central part, the length of the surface of the cushion under the strap being greater than the length of the central part of the strap.

By this solution is achieved a cushion with pressure indicator where the pressure indicator itself is not necessarily directly joined to the cushion but is only surrounding the cushion, or at least a part of the cushion. The fixing of the strap ends to each other can advantageously be provided with hooks that are coupled together by gluing, e.g. with a joining label or by overlap and direct gluing between the strap ends themselves, or by another suitable joining method.

Triggering of the pressure indicator can e.g. occur in that the strap is broken at the central part, in that one end of the strap is detached from a fixation to the other end of the strap, in that the strap is detached from the surface of the cushion, or in that the strap changes its colour and/or shape.

A joining of the strap ends can be provided such that the ends are abutted on each other and joined by a label which is glued/adhered across the ends, but it may also be so that one end overlaps the other end, whereby the strap is joined by a given overlap. Such an overlap may e.g. be with a length of a few millimeters up to several centimeters, and may readily be e.g. 10 centimeters or more, if relevant.

An inflatable cushion according to the invention can, as already mentioned above, include a strap with joining means at the ends for joining the ends.

Such a joining can, as also mentioned above, e.g. be effected by applying a label, an adhesive label, where such labels have regular and uniform material properties, and therefore breaking by application of a regular and uniform action thereon. A label of this kind may advantageously be made of paper that e.g. can be coated with a suitable varnish, whereby is achieved the advantage that fluctuations in air temperature and/or air humidity do not substantially influence the material properties of the label, whereby the breaking properties remain stable and uniform.

A label can also be made of other suitable materials, including a suitable type of plastic film or metal film. Such labels or the strap itself can also be made with perforations that may contribute to indicate a more precisely located breaking zone, and also a more precisely breaking time in relation to pressure and degree of filling, see below for more.

In a preferred embodiment of an inflatable cushion according to the invention, a strap may include a well-defined breaking zone. By a well-defined breaking zone is meant that the breaking zone is made such that breaking will always occur in this zone, and that there is only a very little variance as to when the breaking occurs in relation to the pressure in the cushion. A pressure indicator in the form of a strap can advantageously be made of paper or cardboard or in other relatively stiff material, where a breakage is clearly identified in the strap itself or in a joint between the ends of the strap. A well-defined breaking zone can thus be formed in the strap itself or in the joining means holding the strap together or which hold on the cushion itself.

An inflatable cushion according to the invention may include a pressure indicator in the form of a strap where the strap comprises a pressure-dependent change zone, in principle corresponding to the above mentioned breaking zone with the difference that no breaking in the change zone occurs, but as indicated a change in the physical appearance only. This can also occur on the strap itself and also on a joining part, e.g. on a label joining the strap ends, which also has the property of being able to change physical appearance, thereby indicating a given degree of filling of the cushion.

In yet a preferred variant of an inflatable cushion according to the invention, a pressure indicator in the form of a strap or label can be made of a flexible polymer-opal material or other colour-changing material. Hereby, several advantages are achieved. Among others, the pressure indicator and thereby the cushion can typically be used several times. The mentioned flexible polymer-opal material or other similar material changes its colour when stretched, and again when relieved.

In principle, it is a rubber band that changes colour according to how much it is stretched. By a pressure indicator made as a short strap fixed to the surface of the cushion, or as a longer strap surrounding all of or parts of the cushion, by this variant there is provided a pressure indicator that does not break but only changes visual appearance, i.e. colour, and to some extent also changes its shape, which also can be an indication of a sufficient pressure having been attained.

All of or parts of the cushion can in principle be made of an elastic polymer-opal material where it is the cushion itself or part thereof constituting the pressure indicator. In some cases, such a solution may be preferred.

Furthermore, there may be envisaged yet a kind of pressure indicator which is elastic, and where it is the deformed shape of the elastic pressure indicator indicating that the desired pressure has been provided in the cushion. Here, as by the other types of pressure indicators, it is so that the visual appearance of the indicator indicates the degree of inflation, indicated by the above mentioned change zone. The strap and/or the cushion can include indicating means that entail easier reading of the pressure indicator, which will appear from the explanation to the drawing below and from the Figures.

The invention as indicated above furthermore relates to a method of inflating an inflatable cushion with pressure indicator, the method including at least the following steps:

- connecting an air supply line to the valve opening of the cushion;
- visual localisation of the position of the pressure indicator;
- inflating the cushion until an indication from the pressure indicator appears.

By the said method is achieved inflation of a cushion or similar, where the cushion is selected for the purpose, where a kind of pump is connected, manual, electric or possibly a mouthpiece for manual inflation. Before or during inflation the pressure indicator is located, and the latter is watched until it is indicated in one or the other way that the pressure is sufficient.

A cushion according to the invention can include a plurality of pressure indicators, where respective pressure indicators e.g. are broken one by one as the pressure in the cushion increases. A certain type of cushion can thus be used with various filling degrees and thereby with different levels of hardness. By the hardest filling it may be so that a first as well as a second and a third pressure indicator are to be activated/broken before the correct degree of filling is achieved.

A method according to the invention may further include at least one of the following steps:

- regulating the amount of air in the cushion by supplying additional air;
- regulating the amount of air in the cushion by discharging previously supplied air.

Hereby is achieved possibility of performing individual inflation or regulation of the filling degree with a more or less fixed reference point, namely that the pressure indicator shows a given pressure or given filling degree. In some cases it will be the task of the one filling the cushion with air to perform an individual assessment and then to adapt the hardness of the cushion to the specific application. In other words, a personal experience by the one performing the inflation of the cushion is used. Even if the care assistants doing the work possibly are changing, a uniform result can more easily be achieved as it is done based on the reference filling according to the pressure indicator.

An inflatable cushion with a pressure indicator may advantageously include that the pressure indicator consists of a strap that breaks when the inflation reaches the correct air pressure and thereby correct air volume in the cushion. In the non-inflated condition, the strap may constitute a closed ring surrounding the entire air cushion or parts thereof.

The strap can also be adapted to break when a joint between two straps is breaking. By such a variant it is thus not the strap itself that breaks, but the joint of the two strap ends, but precisely with the same purpose, namely a clear indication of reaching a sufficient pressure or a sufficient filling degree.

The strap can be made of different materials and with varying dimensions, depending on the pressure at which the strap is adapted to be broken. Also, on the strap there may be a defined area at which it is broken at the correct pressure. This area can, like the shape of strap, be of different shape, material, character and strength. Such an area can e.g. be with perforations and with less material thickness or width.

When the strap is broken, the pumping action is stopped, the broken strap is possibly removed and the cushion is adjusted. The strap can advantageously be made of paper, cardboard or similar material with defined and uniform material properties, and possibly with a well-defined breaking zone having breaking strength corresponding to the back pressure exerted by the cushion when the pressure and the filling degree are as desired.

By using a strap made of paper or other breakable material, it will be possible to surround the air cushion or parts thereof in uninflated condition such that when the cushion is inflated, the strap will break when the correct amount of air is in the cushion, as the air exerts a pressure against the entirely or partially surrounding strap exceeding the breaking strength of the strap.

Alternatively, it may be so that a fixation between strap and cushion is broken, or a joint between two parts of the strap is broken as one end of the strap is detached from a fixation to the other end of the strap. A fixation between strap and cushion can also be effected by gluing or by a joining label as mentioned above, where breaking occurs between strap and cushion, indicating a given filling degree via a joining label or a broken glue joint.

Irrespectively which of these variants that are applied, the correct pressure and thereby correct filling degree are indicated by the strap releasing the part of the cushion retained by means of its shorter length.

The cushion will therefore contain the correct amount of air at the moment when the strap breaks, and if the pumping action is stopped at the same time, it is an indication that the cushion contains the correct amount of air related to the intended effect/function.

Supporting persons on air is a good solution for the prevention of pressure sores, why air is often used for mattresses and cushions/pillows in the area of treating and preventing pressure sores.

Some areas of prevention and treatment of pressure sores (heel sores and seat sores) do, however, require a deeper understanding and knowledge about air amount in the supporting items if air is to be used correctly.

Since a large part of care assistants do not have this deep knowledge and training concerning use of support products based on air, the object of the present invention is to provide an indicator which in a simple way indicates correct amount of air in the support items for care assistants without deeper knowledge and training, which is indicated above.

DESCRIPTION OF THE DRAWING

The invention will now be explained below with reference to the drawing, where.

In the explanation of the Figures, identical or corresponding elements will be provided with the same designations in different Figures. Therefore, no explanation of all details will be given in connection with each single Figure/embodiment.

LIST OF DESIGNATIONS

Figure 1:
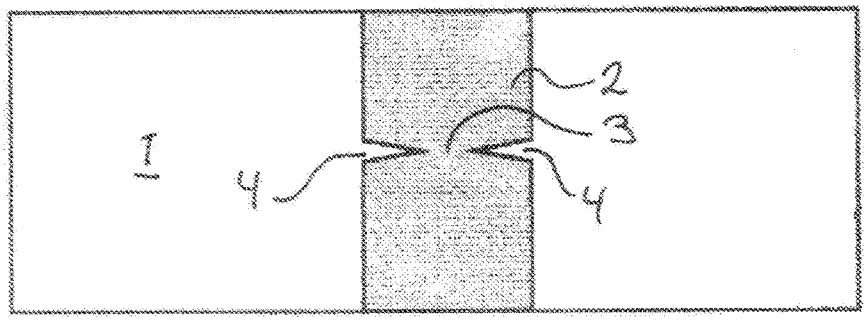
FIG. 1 shows a cushion with a fully surrounding strap.

1 cushion
2 strap
3 breaking zone
4 notch
5 one end of the strap
6 surface of the cushion
7 other end of the strap
8 Opening in the cushion
9 change zone
10 marking on the cushion
11 zone marking on strap
12 central zone
13 intermediate zone
14 outer zone
15 label/joining means

DETAILED DESCRIPTION OF EMBODIMENTS OF THE INVENTION

In FIG. 1 appears an inflatable cushion 1, here shown in non-inflated condition. The cushion 1 is shown in simple form, and it should be envisaged that it is made of one or more plastic film layers that are folded and joined, thus forming an airtight chamber with a not shown valve opening. The cushion 1 is seen here in folded condition where it is shown with a surrounding strap 2 mounted thereon surrounding the entire cushion 1. A well-defined breaking zone 3 appears at the centre of the strap 2, the zone 3 characterised by formation of a notch 4 from either side of the strap, weakening the strap 2.

Figure 2:
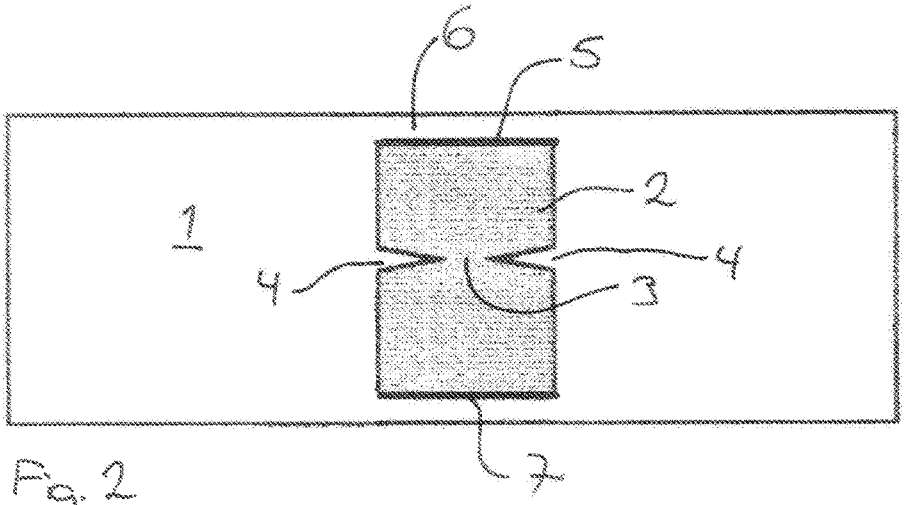
FIG. 2 shows a cushion with a partially surrounding strap.

In FIG. 2 is seen an inflatable cushion 1 as in FIG. 1, but here in another embodiment where the strap 2 at one end 5 is fixed to the surface 6 of the cushion, and at its other end 7 also fixed to the surface 6 of the cushion. The strap 2 is here only partially surrounding the cushion 1 as the cushion 1 is made with a given excess length under the strap 2, whereby the strap 2 will break when the tension in the surface 6 of the cushion becomes too great during inflation.

Figure 3:
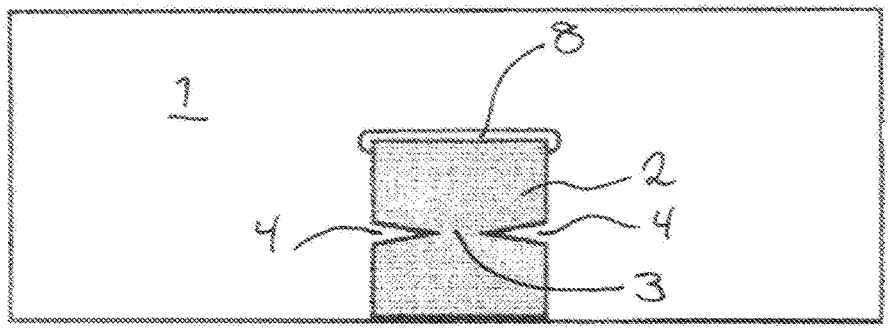
FIG. 3 shows a cushion with a different type of partially surrounding strap.

In FIG. 3 appears a further variant of an inflatable cushion 1, also here shown in non-inflated condition. By this variant of the invention, the strap 2 does not surround the entire cushion 1, but only a part of it as the strap 2 is passed through an opening 8 in the cushion 1. The effect is, however, the same, and when the predetermined pressure is attained, the strap 2 is broken at the breaking zone 3, here also indicated by a notch 4.

The strap 2 may advantageously be made in a colour that clearly differs from the surface of the cushion such that it is easily located.

Figure 4:
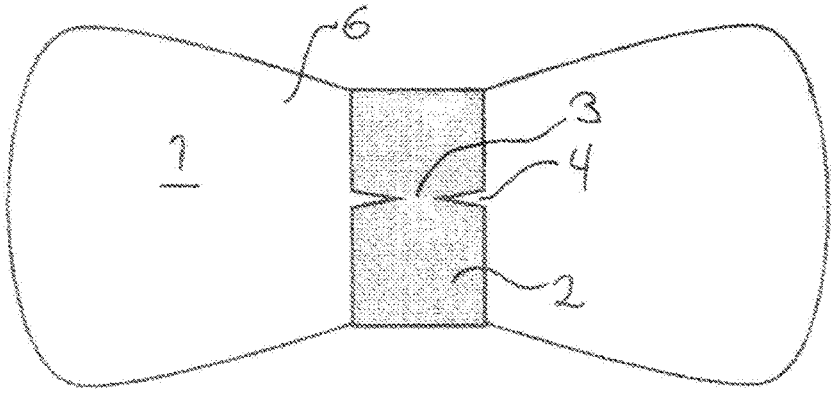
FIG. 4 shows a partially inflated cushion where the strap is not broken.

In FIG. 4, the cushion 1 is seen during filling with air or other medium. The cushion 1 is filled via the not shown valve opening, and as it appears it will gradually unfold, thereby increasing the tension in the strap 2 as seen in this Figure.

Figure 5:
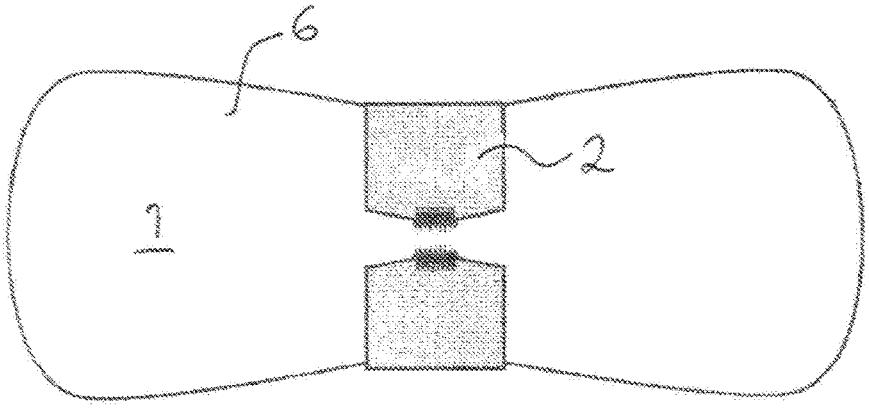
FIG. 5 shows a partially inflated cushion where the strap is broken.

In FIG. 5 the cushion 1 is seen where the strap 2 has just broken, thereby indicating that the cushion 1 is correctly inflated. The shown variant corresponds to the cushion seen in FIG. 1, but the principle is of course the same for the cushion variants shown in FIGS. 2 and 3.

Figure 6:
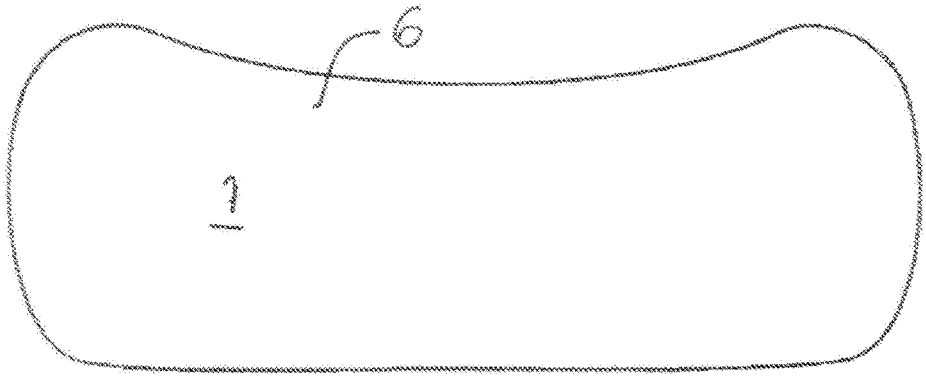
FIG. 6 shows an unfolded cushion after inflating.

In FIG. 6 is seen a correctly inflated cushion 1 where the strap 2 is removed and the cushion 1 is ready for use.

Figure 7:
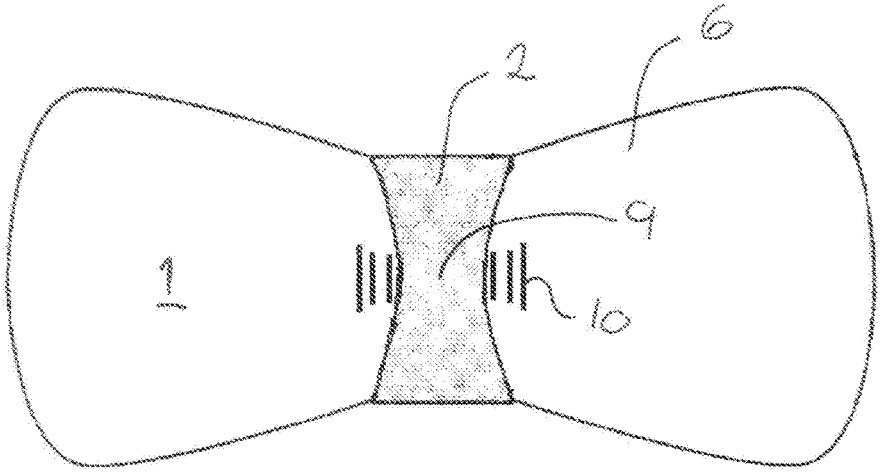
FIG. 7 shows an inflated cushion with a strap with one type of change zone.

FIG. 7 shows a partially inflated cushion, where the strap 2 includes a change zone 9 which, as the name indicates, changes appearance as the pressure increases inside the cushion. The change zone 9 can, as mentioned above, show a deformation or a change in colour. In this case it is a change zone where it is the degree of deformation that indicates a given pressure in the cushion 1. At the surface 6 of the cushion markings 10 are provided such that the width of the strap can be compared with the markings 10.

Figure 8:
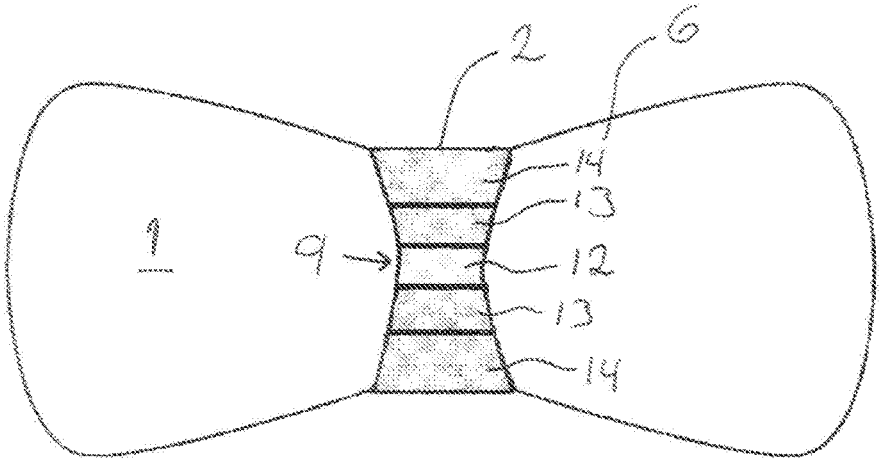
FIG. 8 shows an inflated cushion with a strap with another type of change zone.

In FIG. 8 appears a cushion 1 where the strap 2 also includes change zones 9, but here it is a strap that at least partially consists of an elastic polymer-opal material that changes colour as a function of being stretched. The strap 2 is here shown with zone markings 11 indicating a central zone 12, two intermediate zones 13, one at each side of the central zone 12, and with two outer zones 14, one at each side of the two intermediate zones 13. When the pressure in the cushion 1 is increased or reduced, the strap 2 will indicate this by changing colour to a degree adapted thereto.

Figure 9:
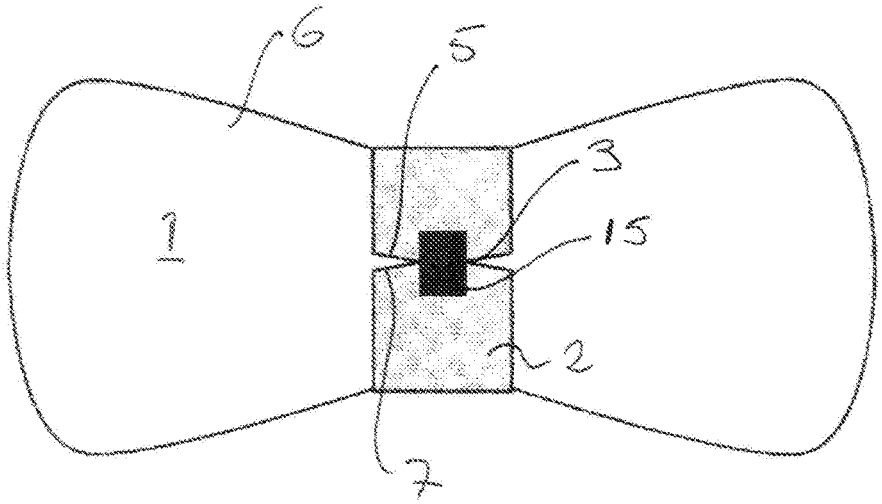
FIG. 9 shows a partially inflated cushion with a strap with an unbroken label.

FIG. 9 shows the cushion 1 during filling with air or another medium. The cushion 1 is filled via the not shown valve opening, and as it appears will gradually unfold, thereby increasing the tension in the strap 2 as seen in this Figure. In this variant, the strap 2 is joined in that the two strap ends 5, 7 are joined with a joining label 15. It is to be noted that a corresponding solution can be applied to a strap as shown in FIGS. 2 and 3.

Figure 10:
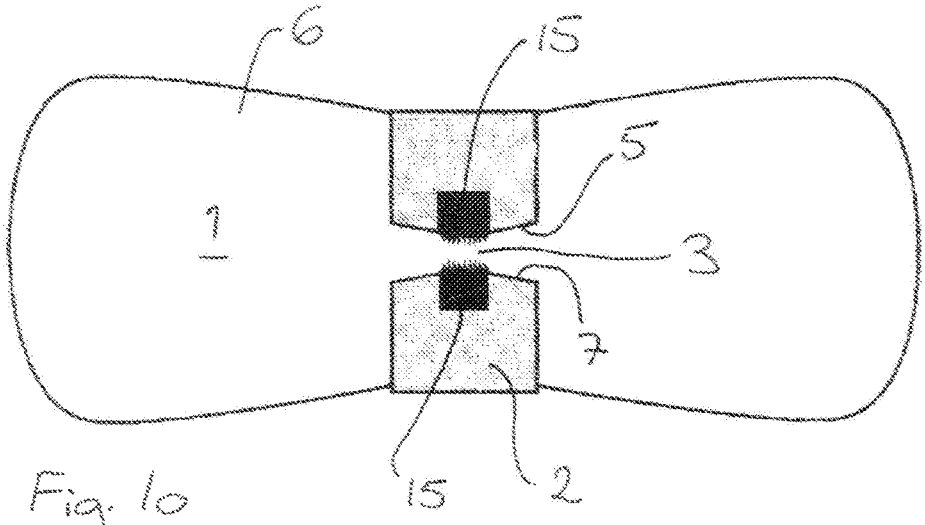
FIG. 10 shows a partially inflated cushion with a strap with a broken label.

In FIG. 10 appears the cushion 1 where the joining label 15 has just broken, thereby indicating that the cushion 1 is correctly inflated. The shown variant corresponds to the cushion seen in FIG. 9, but the principle can, as mentioned, be applied to the cushion variants shown in FIGS. 2 and 3.

In both of FIGS. 9 and 10 showing the same embodiment in various situations, the strap appears with the ends 5, 7 abutting against each other and joined by a label 15, but an overlap between the two strap ends 5, 7 may readily be used where the joint is provided with a label as well.

The invention claimed is:

1. An inflatable air cushion with at least one pressure indicator, the cushion including an outer side and at least one chamber, the at least one chamber made up of one or more films that are joined, thereby forming one or more airtight chambers, the cushion furthermore including a valve opening for connecting an air supply line, the valve opening being accessible from the surface of the cushion, wherein the pressure indicator of the cushion includes at least one strap with a first end and a second end, the at least one strap arranged in relation to the surface of the cushion, where the at least one strap extends around a circumference of the cushion so as to surround the cushion entirely, and where the at least one strap is adapted such that the physical appearance of the strap is changed at a given pressure in the cushion, thus constituting a pressure indicator, by providing at least one single use paper or polymer strap extending around an entire circumference of the cushion, wherein the first end and the second end of the strap are joined to each other to enable breaking of the at least one strap or to enable color change of the at least one strap to indicate sufficient inflation of the cushion.

2. Inflatable cushion according to claim 1, wherein the at least one strap between the first end and the second end includes a central part, the length of the surface of the cushion between the first and the second fixations being greater than the length of the central part of the strap.

3. Inflatable cushion according to claim 1, wherein the strap between the first end and the second end includes a central part, the length of the surface of the cushion under the strap being greater than the length of the central part of the strap.

4. Inflatable cushion according to claim 3, wherein a strap includes joining means at the ends for joining the ends.

5. Inflatable cushion according to claim 1, wherein a strap includes a well-defined breaking zone.

6. Inflatable cushion according to claim 1, wherein a strap includes a pressure-dependent change zone.

7. Inflatable cushion according to claim 1, wherein a strap is made of a flexible polymer-opal material.

8. Method according to claim 7, wherein the method further includes at least one of the following steps:

regulating the amount of air in the cushion by supplying additional air;

regulating the amount of air in the cushion by discharging previously supplied air.

9. A method for inflating an inflatable cushion with pressure indicator according to claim 1, wherein the method includes at least the following steps:

providing at least one single use paper or polymer strap that extends entirely around the cushion with ends of the strap joined to each other, connecting an air supply line to the valve opening of the cushion;

visual localisation of the position of the pressure indicator;

inflating the cushion until an indication from the pressure indicator appears by breaking of the at least one strap or by colour change of the at least one strap.

* * * * *